United States Patent [19]

Ballestrazzi et al.

[11] Patent Number: 4,709,537

[45] Date of Patent: Dec. 1, 1987

[54] LONGITUDINAL WELDING EQUIPMENT IN A PACKER MACHINE

[75] Inventors: Aris Ballestrazzi; Lamberto Tassi, both of Savignano Sul Panaro, Italy

[73] Assignee: Sitma- Societa Italiana Macchine Automatiche S.p.A., Spilamberto, Italy

[21] Appl. No.: 908,783

[22] Filed: Sep. 18, 1986

[30] Foreign Application Priority Data

Sep. 24, 1985 [IT] Italy ..... 23205/85[U]

[51] Int. Cl.[4] ..... B65B 9/06

[52] U.S. Cl. ..... 53/550; 53/373; 219/243; 493/193

[58] Field of Search ..... 53/550, 373, 551, 450, 53/477; 219/243; 493/193

[56] References Cited

U.S. PATENT DOCUMENTS

| | | | |
|---|---|---|---|
| 2,919,990 | 1/1960 | Podlesak et al. | 53/550 |
| 4,330,351 | 5/1982 | LoMaglio | 53/550 |
| 4,381,637 | 5/1983 | Ballestrazzi et al. | 53/550 |
| 4,546,595 | 10/1985 | Yasumune et al. | 53/550 |

FOREIGN PATENT DOCUMENTS

| | | | |
|---|---|---|---|
| 2411387 | 9/1974 | Fed. Rep. of Germany | 53/550 |

*Primary Examiner*—John Sipos
*Assistant Examiner*—Donald R. Studebaker
*Attorney, Agent, or Firm*—Fleit, Jacobson, Cohn & Price

[57] ABSTRACT

Longitudinal welding equipment in a machine for packaging products fed on a conveyor belt inside a continuous film of plastic material wrapped around the products with overlapping longitudinal side edges. The equipment comprises a longitudinal welding means positioned above the edges of the means for generating an oscillatory rotary-translational motion on a vertical plane. Furthermore, the equipment provides at least one pressure and accompanying belt a top of the products wrapped inside the film. The welding means and the pressure belt are operatively driven by the same central motor means which actuates said conveyor belt. The welding means is equipped with a means for temperature control operatively connected to the packaging speed.

5 Claims, 4 Drawing Figures

LONGITUDINAL WELDING EQUIPMENT IN A PACKER MACHINE

The present invention relates to a longitudinal welding equipment in a packer machine.

Some packer machines for products fed sequentially after each other, use continuous films of plastic sheet, (whether of heat-shrinking type or not), to wrap around the products. It is known to weld such a sheet film by wrapping around the product transversely to the feeding direction, both of the products and of the film, so to accomplish an at least partially closed packing.

It must be observed indeed that the longitudinal overlapping edges of said film remain in any case free. Thus, it is in someway possible to carry out an action on the accomplished packing, or to tamper with it.

In a view of such a fact, it results advantageous to weld the overlapping edges to each other, so to completely seal the package. Thus, it is completely impossible to tamper with the product contained inside the film.

This further operation of longitudinal welding involves a further handling of the transversely welded packages. Thus, the further handling increases the packing costs and sometimes renders necessary the availability of a further operator to carry out this latter operation.

The main purpose of the present invention is to provide an equipment for the longitudinal welding of said film edges overlapping to wrap the products. The equipment operates continuously, automatically, and solidly with the packer machine. Thus, the equipment avoids any further interventions from the outside.

This and further purposes according to the present invention are achieved by providing a longitudinal welding equipment in a machine for packaging products fed on a conveyor belt inside a continuous film of plastic material wrapped around said products with overlapping longitudinal side edges. The invention is characterized in that it comprises a welding means positioned above said edges on a means for generating an oscillatory rotary-translational motion on a vertical plane. Furthermore, the invention provides at least one pressure and accompanying belt atop said products being packaged inside said film. The welding means and said pressure belt being operatively driven by the same central motor means which actuates said conveyor belt. The welding means is equipped with means for temperature control which is operatively connected to the packaging speed.

The structural and functional characteristics, as well as, the advantages of the equipment according to the present invention shall be better understandable from the following exemplifying and not limitative disclosure referring to the related drawings, wherein.

Figure 1:
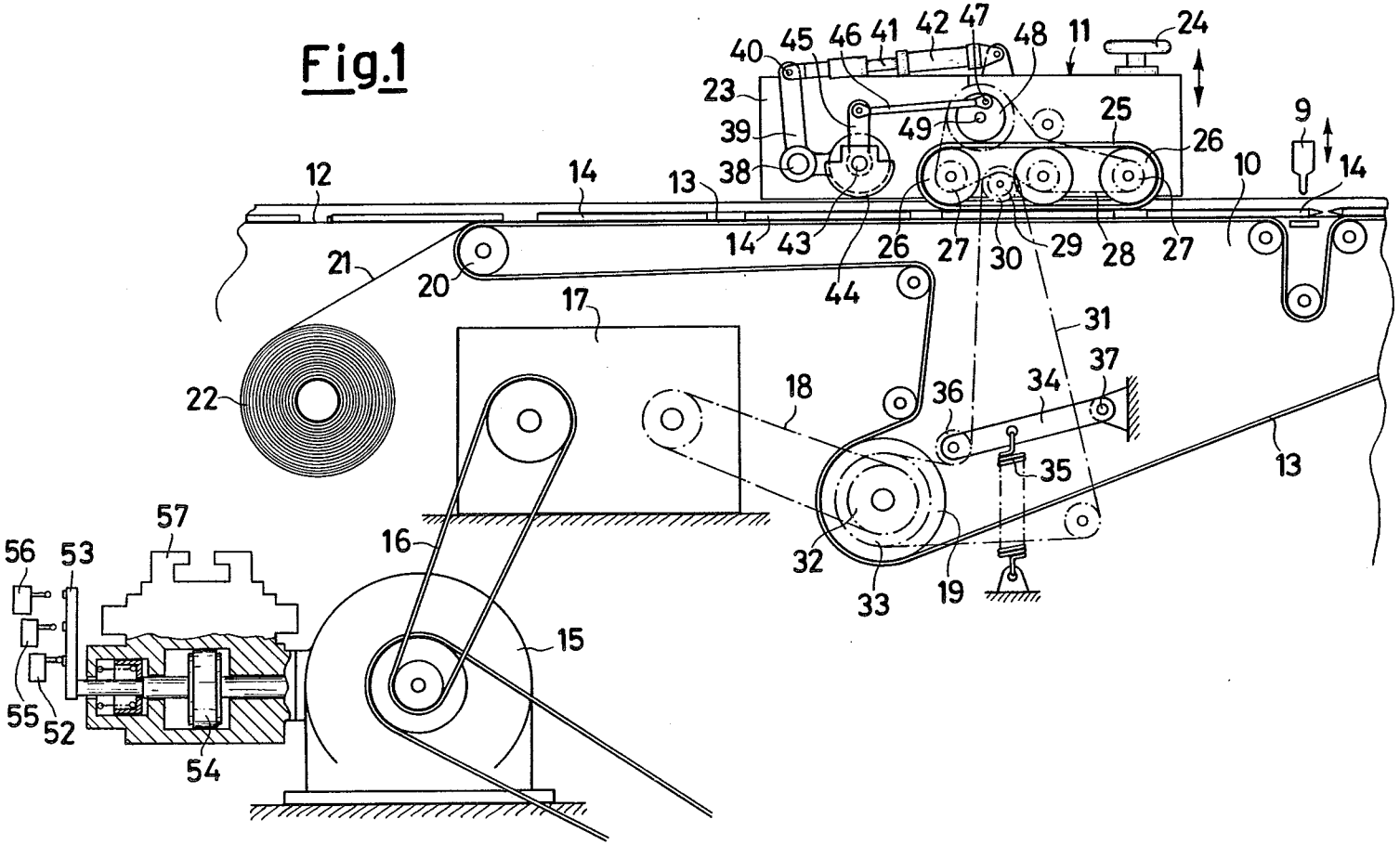
FIG. 1 is a schematic side view of the equipment according to the invention.
Figure 2:
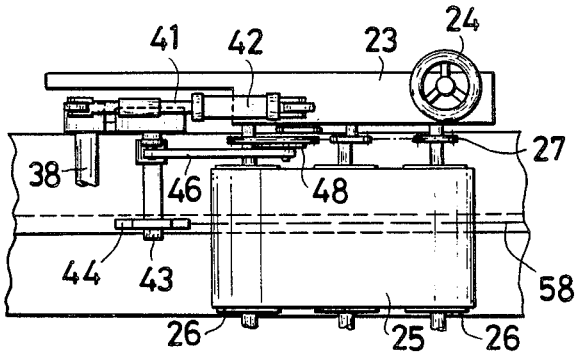
FIG. 2 is a partial top view of the equipment of FIG. 1.

Referring to FIGS. 1 and 2, a side wall 10 of a packer machine supports a longitudinal welding equipment according to the present invention, generally indicated with 11.

The packer machine comprises essentially a conveyor belt 13 for the conveyance of a set of products 14 to be packed. The products are fed on the belt by means of pusher means schematically shown in 12.

A central ratiomotor 15 actuates, by means of a belt transmission 16, a further intermediate speed variator 17. The speed variator 17, via a chain transmission 18, is installed in series to and actuates a drive roller 19. The conveyor belt 13 is driven around by the drive roller 19.

In correspondence of the area into which the products 14 are fed, is provided a return roller 20 for the return of belt 13. Also, return roller 20 drives a film of plastic material 21 which is unrolled from a spool 22. The plastic material 21 gets interposed between the conveyor belt 13 and the products 14 to be packaged.

In a known way, the continuous film 21 is completely wrapped around said products 14 with overlapping longitudinal side edges, before coming to the longitudinal welding machine 11 and to a transversal welding device schematically shown in 9.

The equipment 11 comprises a pair of support side shoulders 23 which are positioned above the side wall 10 of the frame. The shoulders 23 are operatively and vertically movable by a pressure handwheel 24 with varying thickness of products 14, so to cause the same products to engage a pressure and accompanying belt 25.

Said pressure and accompanying belt 25 is positioned in closed loop supported by at least one pair of end rollers 26. The end rollers 26 are rotatably constrained to said pair of shoulders 23 and laterally provided with sprocket wheels 27. The sprocket wheels are solid with said rollers 26 and actuated by a chain transmission 28.

A sprocket wheel 29 actuates said chain transmission 28 and is axially made solid with and coupled to a second sprocket wheel 30. Sprocket wheel 30 has a different diameter and a different number of teeth. Also, it is in turn driven by a chain transmission 31.

Two sprocket wheels 32 and 33, having a different number of teeth, are laterally keyed onto said drive roller 19 and are respectively connected. The first sprocket wheel 32 is connected to the chain transmission 18 coming from the intermediate speed variator 17. The second sprocket wheel 33 is connected to the chain transmission 31 and actuates the longitudinal welding equipment 11.

This latter chain transmission 31 is provided with a chain tightening lever which is articulated in 37 relatively to the side wall 10. The chain tightening lever 34 is kept in its operating position by an elastic element or spring 35. The lever 34 being hinged on its free end by a small return idle sprocket wheel 36.

The side shoulders 23 support, centrally hinged on a shaft 38, a bell crank 39. The bell crank 39 is hinged in 40, at an upper end thereof, to an adjustable stem 41 of a cylinder 42. The cylinder 42 is articulatedly fastened to the same shoulders 23. Also, bell crank 39 bears, hinged in 43 and at another end thereof, a longitudinal welding means 44. The longitudinal welding means 44 is of rocking type with a welder body of the type constituted by a bar of circular shape, (e.g., by a wire). The longitudinal welding means 44 is arranged in the same direction of motion of the products and such to accomplish a continuous weld 58.

The body of the welding means 44 extends in a compound lever system constituted by a rocker lever 45 and a connecting rod 46. The free end of said connecting rod being hinged in 47 to a crank-pinion 48. The connecting rod 46 is rotatably and axially supported in 49 onto at least one shoulder 23. The pinion 48 is driven to rotate by the same chain transmission 28 which actuates the accompanying belt 25.

The crank-pinion 48 together with the connecting rod 46 and the crank 45 constitute the articulated quadrilateral. This converts the continuous rotary motion of the crank-pinion 48 into the reciprocating rocking motion of the crank 45 and of the longitudinal welding means 44 solid therewith.

The bell crank 39 and the cylinder 42 constitute the device which lowers and lifts the longitudinal welder 44 at each start-up or shut-down of the packer machine.

The use of a nearly continuously operating hot-bar longitudinal welding means 44 requires necessarily a suitable control of the welding temperature. The welding temperature must depend on the material to be welded and, also, on the variations in packing speed.

Figure 3:
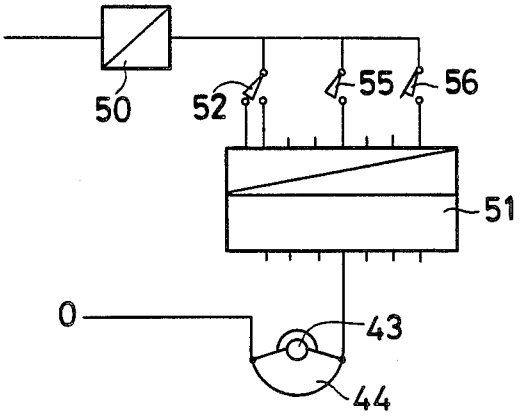
FIG. 3 shows the electrical wiring diagram of the welding equipment according to the invention.

To that purpose an adjustment element 50, e.g., a voltage adjuster (FIG. 3) is provided. Adjustment element 50 is properly set during the packer machine start-up step, so to have a certain input-output value on a transformer 51.

This is determined by the use, e.g., of a first microswitch 52 engaged by a plate 53 connected to a distributer-box 54. The distributor-box 54 is actuated by the speed changes of the central ratiomotor 15.

Figure 4:
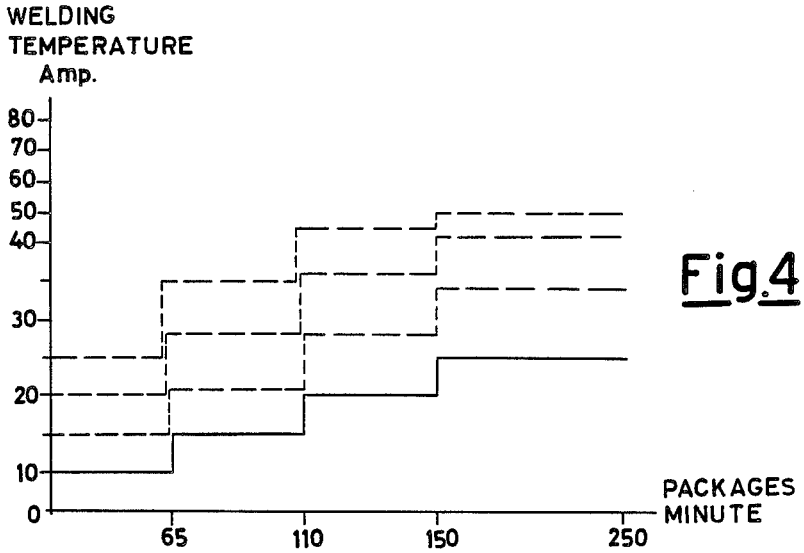
FIG. 4 is a chart exemplifying the temperature change of the welding element as a function of the packing speed.

In fact, as soon as the speed exceeds a predetermined first value (FIG. 4), the distributor-box 54 is actuated to move. This causes, by means of the plate 53, the engagement of not only the first microswitch 52, but also of a second microswitch 55 with switch over of the input to transformer 51.

The switch over involves an increasing voltage level (see FIG. 4) and consequently a related to increase in temperature of the welding means 44. This switch over compensates for the greater removal of heat from the welder 44, which acts on a greater number of products 14 being packed.

The same effect of further increase of temperature is obtained by means of a third microswitch 56. The third microswitch 56 gets switched on when the packer machine comes close to the highest packing speed.

In an equivalent way, the various microswitches are switched off when the packing speed of the machine decreases, so to accomplish means for adjusting the temperature with varying packaging speed.

If, for example, the central ratiomotor 15 comprises such a linear actuator as a pump, the motion of the distributor-box 54 controlled by an electrovalve 57, besides varying the pump flow rate, switches on the various microswitches performing the adjustment of the temperature of the welding means.

We claim:

1. Longitudinal welding equipment in a machine for packaging products comprising a horizontal conveyor belt for transporting said products wrapped inside a continuous film of plastic material with said material having overlapping longitudinal side edges, a longitudinal welding means positioned above said overlapped edges, means for imparting an oscillatory rotary-translational motion to said longitudinal welding means in a vertical plane, at least one pressure and accompanying belt located above said products wrapped in side said film, at least one side shoulder mounted above said products for positioning said at least one pressure and accompanying belt above said conveyor belt, central motor means for operatively driving in common said longitudinal welding means and said pressure belt and said conveyor belt, and temperature means for selectively controlling the temperature of said longitudinal welding means to correlate with the packaging speed.

2. The longitudinal welding equipment according to claim 1, wherein said welding means comprises a welder body having a bar of circular shape positioned in the direction of motion of the products, a compound lever system having a rocker lever and a connecting rod for controlling said welder body, said welder body being connected to be moved by said compound lever system, a crank-pinion mounted to said at least one side shoulder connected to said connecting rod, a transmission operatively connected to said central motor means for actuating said crank-pinion to impart said oscillatory rotary-translational motion to said welder body above said overlapping lateral edges of said materal.

3. The longitudinal welding equipment according to claim 1, further comprising a bell crank centrally hinged to said at least one shoulder and having two ends, one said end being hinged to said welder body, an actuator cylinder having a stem rotatably connected to the other end of said bell crank, actuation of said bell crank serving to lower and lift said welder means at each start-up or shut-down of the machine for packaging products.

4. The longitudinal welding equipment according to claim 1, wherein said temperature means comprises a transformer connected to said welding means for providing input-output voltage and a presettable adjustment operatively connected to said transformer comprised of a set of microswitches sequentially actuated with varying packaging speed to switch over the input-output voltage of the transformer.

5. The longitudinal welding equipment according to claim 4, wherein an actuator, being driven by said central motor means, actuates said microswitches.

* * * * *